United States Patent [19]

Sevink

[11] Patent Number: 4,486,888

[45] Date of Patent: Dec. 4, 1984

[54] FURNACE, ESPECIALLY A CERAMIC OR HEATING FURNACE

[76] Inventor: Theodor J. Sevink, Schaepmanstraat 54,, 3762 SV Soest, Netherlands

[21] Appl. No.: 293,731

[22] Filed: Aug. 17, 1981

[51] Int. Cl.[3] ..... F27D 1/00; F27D 11/02

[52] U.S. Cl. ..... 373/130; 373/137

[58] Field of Search ..... 373/130, 137, 119; 219/406, 408, 531, 343; 432/238, 249, 250, 252

[56] References Cited

U.S. PATENT DOCUMENTS

| | | | |
|---|---|---|---|
| 3,350,493 | 10/1967 | Randall | 219/390 X |
| 3,786,162 | 1/1974 | Colson | 219/406 |
| 4,088,825 | 5/1978 | Carr | 373/130 |
| 4,154,975 | 5/1979 | Sauder | 373/130 |
| 4,215,265 | 7/1980 | White | 219/390 |
| 4,249,888 | 2/1981 | Werych | 373/137 |

*Primary Examiner*—Roy N. Envall, Jr.

*Attorney, Agent, or Firm*—Sughrue, Mion, Zinn, Macpeak & Seas

[57] ABSTRACT

A furnace includes a jacket (1) which is removably mounted to a bottom plate construction (2) so that the jacket can be mounted on any one of a number of the bottom plate constructions. A cap (3) is removably secured on an upper part of the jacket by latches (4), and electric resistance elements (16, 22) are mounted adjacent to an inner surface of the jacket by a plurality of strips (14) having pins (15) thereon. Since the jacket is removably mounted on the bottom plate construction, after a burning process has been completed, the jacket can be removed from the bottom plate construction and placed on another similar bottom plate construction to initiate another burning process while the products which have been previously burned are allowed to cool. In the event that quick cooling of the products is not desirable, the cap may be removed and replaced by a simple, intermediate cap so that the products are allowed to cool more slowly.

10 Claims, 4 Drawing Figures

FURNACE, ESPECIALLY A CERAMIC OR HEATING FURNACE

The present invention relates to a furnace, particularly a ceramic or heating furnace, consisting of a casing, the jacket and bottom of which are coated with a heat-insulating material and the open top is adapted to be closed with a cap, which is also coated with heat-insulating material, and heating means being provided. Such a furnace is generally known.

A disadvantage of the known furnace is that after the termination of the burning process the cap has to be left open for some time before the, then cooled, products can be taken from the furnace and the furnace can be loaded again, so that there is a loss in time and heat.

It is the object of the present invention to provide a furnace of the above mentioned type, which does not have said disadvantage.

This object is achieved in that in the furnace according to the invention, the bottom of the casing is formed by a bottom plate construction on which the jacket of the casing rests removably, and the cap is secured to the jacket by means of disengageable connection means.

In this way it is possible, after the termination of the burning process, to lift the jacket with the closed cap from the bottom plate and to place it on another bottom plate, after which a next burning process can be started immediately, whereas the product on the first bottom plate can cool. If, however, the products as achieved do not permit such a rather unequal cooling, then it is possible first to remove the cap and to leave the furnace open for some time, before placing the jacket with cap on another bottom plate.

The bottom plate construction advantageously comprises a lower layer of concrete or a similar material on which, while leaving the outer portions of the top surface uncovered, the insulating material is provided, whereas the lower side of the jacket of the casing rests on said outer portions under intermediary of a layer of sealing insulating material, whereby the heat insulating material with which the bottom plate is coated, is connected by means of a scalariform joint to the heat-insulating material with which the jacket is coated.

The heat-insulating material is preferably formed by layers of a felt material. In this way the jacket and cap have a considerably small weight relative to the known furnace which is coated with ceramic material, so that said portions can be lifted easily.

When using felt material for the heat-insulating material of the bottom plate construction, uprights are secured in the layer of concrete, which uprights extend through the felt layers, as provided on the layer of concrete, and carry at their tops a load-supporting plate of ceramic material.

When using electric resistance elements to heat the furnace, the walls of the jacket are coated with a pile of horizontally deposed layers of the felt material, whereas at certain places between two of said layers a strip of ceramic material is clamped, which is provided with pins from which the electric resistance elements are suspended.

Because of what is mentioned above it is no longer necessary for a constructor for furnaces to provide numerous little pins separately. Furthermore there is particularly no contact between the elements and the furnace wall, so that there is no direct heat-flow to said wall, so that the furnace is more economic and it is possible to let the burning process take place up to a higher temperature.

The above mentioned strips can be formed according to two mutually different embodiments. The first embodiment is characterized by the feature that the pins consist of inwardly, freely protruding hooks.

It is also possible, however, that the pins of the strip are provided between two layers of heat-insulating material, and that the pins are provided with a protrusion to keep the resistance elements spaced from the layers. The pins may have a lens-shape when considered in cross-section and, starting at the protrusion, they may have a T-shaped cross-section. Thereby the lowest possible heat transfer by conduction is achieved.

When using burners to heat the furnace said burners may advantageously be provided in the cap. Thus after termination of the burning process the cap with the valuable burners and pertaining protection means can be placed on another jacket which is already loaded. In this way the valuable apparatus can be used continuously and the furnace is not useless during the cooling period. If the burnt or heated products do not permit the furnace to be suddenly and completely opened, then a simple intermediate cap may be provided which remains on the furnace when the main cap and the burners are removed.

It is also possible that the burners and protection means are mounted on a displaceable frame and to remove only this frame and to place it on a successive furnace if a quick cooling action is not desired.

It is remarked that a so-called bell-furnace is known which is composed of a bell-shaped section which rests on a bottom and can be lifted as a whole from said bottom. In this type of furnace the load cannot cool equally after being burnt.

The invention is further described on the basis of the drawing, in which

Figure 1:
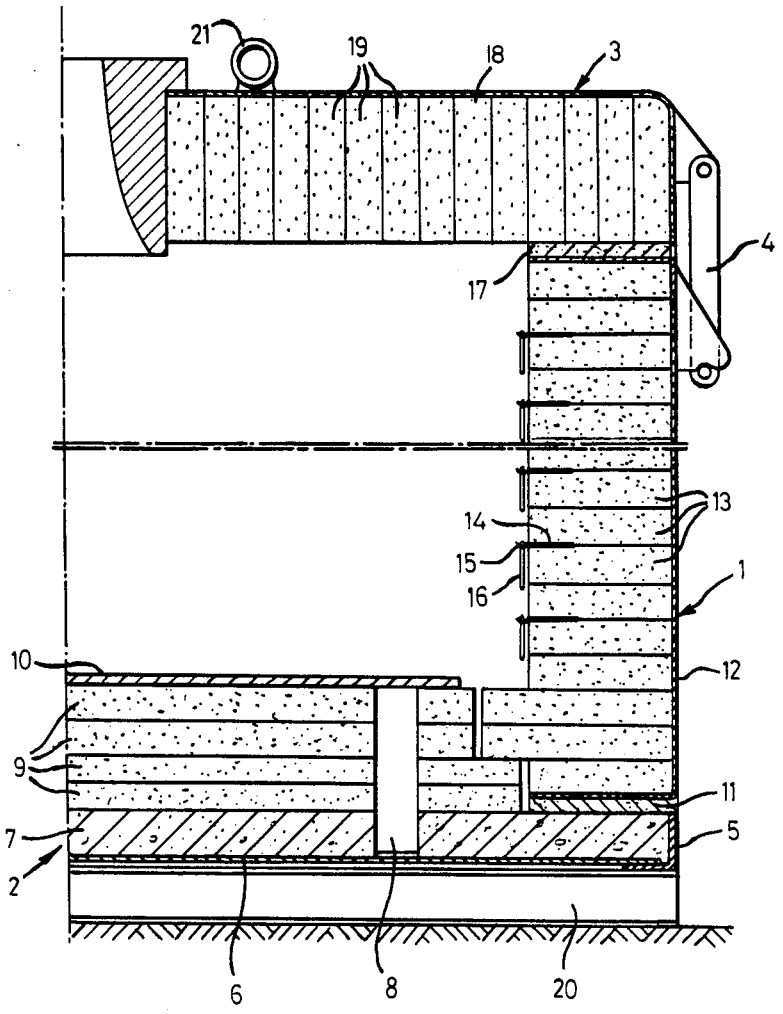
FIG. 1 is a cross-section through a part of the furnace according to the invention.

As shown in FIG. 1 the furnace comprises a jacket 1, which rests disengageably on a bottom plate construction 2, whereas the jacket is closed at its top by means of a cap 3 which is removably secured on the jacket by means of latches 4.

The bottom plate construction 2 comprises a frame which is formed by angle-irons 5 in which the steel plate 6 is placed. On the plate 6 a layer of concrete 7 is provided, in which the uprights 8 are received. On the plate of concrete 7 layers 9 of felt material are provided, whereas on the uprights 8 a plate 10 rests, which is made of ceramic material and which supports the load. The outer sections of the layer of concrete 7 are coated by a layer 11 of a sealing, insulating material on which the jacket 1 rests.

The jacket 1 comprises an envelope 12 of plate steel, in which the layers of felt material 13 are provided, and in which the lower layers 13 are connected to the felt layers 9 of the bottom plate by means of a scalariform joint.

At certain places between two felt layers 13, the strips 14 of ceramic material are clamped, which are provided with the inwardly, freely projecting hooks 15, from which the electric resistance elements 16 are suspended.

At the top of the envelope 12 a layer of sealingly insulating material 17 is provided, on which the cap 3 rests.

The cap 3 comprises an envelope 18 of plate sheet, in which the felt layers 19 are bonded.

The complete furnace rests on a foot 20.

A support eye 21 is welded to the envelope, and with the aid of said eye either the cap 3 and jacket 1 can be lifted as a whole from the bottom plate construction 2 when the latches 4 are closed, or when the latches 4 are opened, only the cap 3 can be lifted from the jacket 1.

Figure 2:
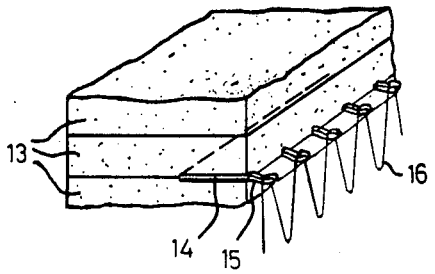
FIG. 2 is a perspective view, in which the way of securing the electric resistance elements is shown.
Figure 3:
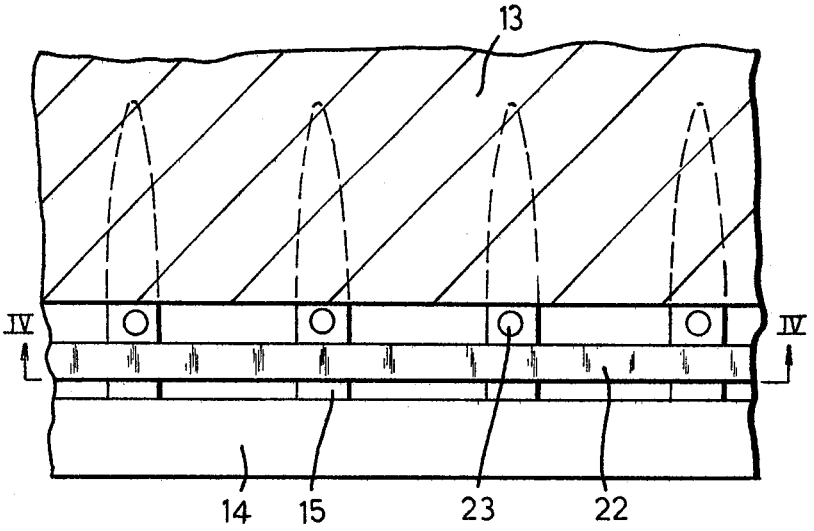
FIG. 3 is a plane view of a second embodiment of a strip.
Figure 4:
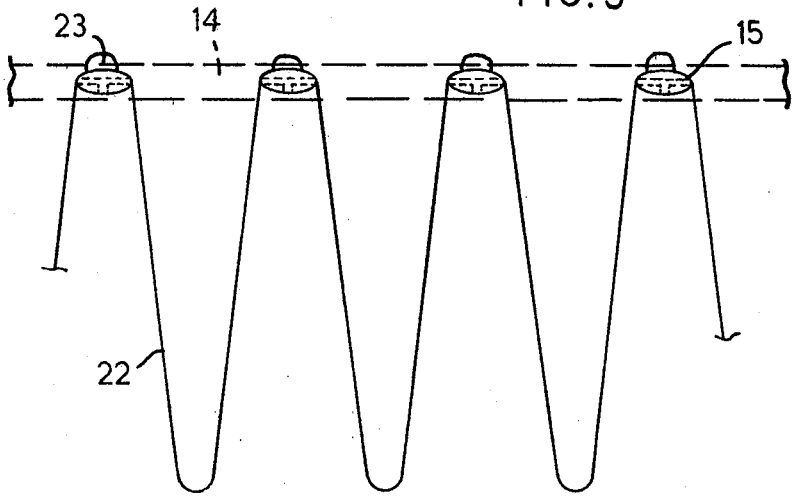
FIG. 4 is a cross-section according to the line IV—IV of FIG. 3.

In FIG. 2 the electric resistance elements 16 are drawn in the configuration of filaments, but mostly this will not be so. A normal capacity of a furnace is 4 kW and this can be produced by four folded belts 22 of 5×0.6 mm cantale steel. A part of one of such belts is shown in FIGS. 3 and 4. In said figure, the ceramic strip 14 is just outside the felt layer 13, whereas the pins 15 project into the felt layer now.

Protrusions 23 are provided on said pins, which protrusions serve as spacers. The cross-section of the pins is preferably lens-shaped, which can simply be achieved by means of spacing plaster blocks, with the aid of which the casting mould for the strips are made, when making holes in the separation surface.

The pins may also be a different cross-section at the location of the filter layer, as indicated in FIG. 4 by dotted lines, namely a T-shaped cross-section which is beneficial for correctly securing them and at the same time provides the lowest possible heat transfer by conduction.

I claim:

1. A furnace comprising:

first, second and third heat-insulating layers of felt (9, 13, 19);

a bottom plate construction (2) having said first heat-insulating layers of felt (9) formed on an upper surface thereof;

a jacket (1) having said second heat-insulating layers of felt (13) formed on an inner surface thereof;

a cap (3) mounted on an upper surface of said jacket for enclosing said furnace, said cap having said third heat-insulating layers of felt (19) on a lower surface thereof; and strips of ceramic material (14) having a plurality of spaced tapered pins (15), said pins being inserted in said heat insulating layers and suspending electric resistance elements (22).

2. The furnace as claimed in claim 1, wherein said pins include protrusions (23) for keeping said electric resistance elements spaced from said second heat-insulating layers of felt.

3. The furnace as claimed in claim 2, wherein said pins have a lens-shaped cross-section at an outer section thereof.

4. The furnace as claimed in claim 3, wherein said pins have a T-shaped cross-section at a section thereof adjacent said inner surface of said jacket.

5. The furnace as claimed in claim 1, wherein said strips interconnect outer ends of said pins, said strips being disposed in an area enclosed by said heat-insulating layers.

6. A furnace, comprising:

first, second and third heat-insulating layers of felt (9, 13, 19);

a bottom plate construction (2) having said first heat-insulating layers of felt (9) formed on an upper surface thereof;

a jacket (1) having said second heat-insulating layers of felt (13) formed on an inner surface thereof;

means for removably mounting said jacket on said bottom plate construction so that said jacket can be mounted on any one of a number of said bottom plate constructions;

a cap (3) removably mounted on an upper surface of said jacket for enclosing said furnace, said cap having said third heat-insulating layers of felt (19) on a lower surface thereof;

means (16, 26) for heating said furnace, said heating means comprising a burner formed in said cap;

means (4) for disengageably securing said cap to a top of said jacket so that said cap can be completely removed from said jacket; and strips of ceramic material (14) having a plurality of spaced tapered insulating pins (15), said pins inserted into said heat-insulating layers and suspending electrical resistance elements.

7. The furnace as claimed in claim 1, wherein said bottom plate construction comprises a lower layer of concrete material (7) having inner and outer portions, said first heat-insulating layers of felt being provided on said inner portion of said lower layer of concrete, a layer of sealing insulating material (11) provided on said outer portions of said lower layer of concrete, a lower section of said jacket resting on said layer of sealing insulating material.

8. The furnace as claimed in claim 7, wherein said removable mounting means comprises a scalariform joint, said scalariform joint interconnecting said first and second heat-insulating layers of felt provided on said bottom plate construction and said jacket, respectively.

9. The furnace as claimed in claim 8, further comprising:

a layer of concrete uprights (8) secured by said lower layer of concrete and which extends through said first heat-insulating layer of felt; and a load supporting plate (10) made of ceramic materials supported by upper portions of said layer of concrete uprights.

10. The furnace as claimed in claim 6, further comprising a removable frame, said burners being mounted on said removable frame.

* * * * *